United States Patent [19]

Boyum

[11] 4,197,701

[45] Apr. 15, 1980

[54] METHOD AND APPARATUS FOR COMBUSTING CARBONACEOUS FUEL

[75] Inventor: Asmund A. Boyum, Brooklyn, N.Y.

[73] Assignee: Engelhard Minerals & Chemicals Corporation, Iselin, N.J.

[21] Appl. No.: 878,839

[22] Filed: Feb. 17, 1978

Related U.S. Application Data

[63] Continuation-in-part of Ser. No. 645,017, Dec. 29, 1975, abandoned.

[51] Int. Cl.[2] ..... F02C 3/20; F02C 7/26

[52] U.S. Cl. ..... 60/39.06; 60/34.46 P; 431/7

[58] Field of Search ..... 60/39.02, 39.06, 39.46 P, 60/39.52, 39.82 P, 39.69 A; 431/7, 328

[56] References Cited

U.S. PATENT DOCUMENTS

| | | | |
|---|---|---|---|
| 2,854,819 | 10/1958 | Walker | 60/39.82 C |
| 2,906,092 | 9/1959 | Haltenberger | 60/39.52 |
| 3,844,113 | 10/1974 | Lockwood | 60/39.52 |
| 3,940,923 | 3/1976 | Pfefferle | 60/39.02 |

FOREIGN PATENT DOCUMENTS

| | | | |
|---|---|---|---|
| 941830 | 11/1963 | United Kingdom | 60/39.46 P |

*Primary Examiner*—Louis J. Casaregola

[57] ABSTRACT

A first mixture of carbonaceous fuel and air is passed into the presence of a catalyst for essentially adiabatic combustion at a temperature above the instantaneous auto-ignition temperature of the mixture but below about 3,000° F., thus avoiding nitrogen-oxide-forming temperatures. The gaseous effluent of this combustion is mixed with an additional fuel-containing component, which differs from the first mixture and which may utilize a different fuel, and the resulting mixture is homogeneously combusted at a temperature above the catalyst temperature, and above about 2,500° F., to produce a gaseous effluent for use as a source of heat or power.

10 Claims, 4 Drawing Figures

METHOD AND APPARATUS FOR COMBUSTING CARBONACEOUS FUEL

CROSS-REFERENCE TO RELATED APPLICATION

This is a continuation in part of application Ser. No. 645,017 filed on Dec. 29, 1975, now abandoned.

BACKGROUND OF THE INVENTION

This invention relates to methods and apparatus for combusting carbonaceous fuels, and more particularly to methods and apparatus for combusting carbonaceous fuels to produce a hot gaseous effluent for use a source of heat (e.g., in a furnace) or power (e.g., as a motive fluid in a turbine system).

In U.S. patent application Ser. No. 358,411, now U.S. Pat. No. 3,928,961, filed May 8, 1973, in the name of William C. Pfefferle and assigned to the same assignee as that of the present invention, and incorporated herein by reference, there is disclosed a process designated catalytically-supported, thermal combustion. According to this method, carbonaceous fuels can be combusted very efficiently and at thermal reaction rates in the presence of a solid oxidation catalyst at temperatures below nitrogen-oxide-forming temperatures. As described in application Ser. No. 348,411, this combustion method involves essentially adiabatic combustion of a mixture of fuel and air, or of fuel, air, and inert gases, in the presence of a catalyst operating at a temperature substantially above the instantaneous auto-ignition temperature of the mixture, but below a temperature that would result in any substantial formation of oxides of nitrogen. Essentially adiabatic combustion means that the operating temperature of the catalyst does not differ by more than about 300° F., more typically no more than about 150° F., from the adiabatic flame temperature of the mixture due to the heat losses from the catalyst. The instantaneous auto-ignition temperature of the mixture is defined herein and in application Ser. No. 358,411 to mean the temperature at which the ignition lag of the mixture entering the catalyst is negligible relative to the residence time in the combustion zone of the mixture undergoing combustion. Typically, the operating temperature of the catalyst is in the range from about 1,700° to about 3,200° F., preferably from about 2,000° to about 3,000° F. As pointed out in application Ser. No. 358,411, the combustion occurs under these conditions at a rate substantially higher than the conventional catalytic combustion rate. Combustion of the gases exiting from the catalyst zone may be substantially complete, or combustion may continue downstream of the zone containing the catalyst.

Various detailed systems have been devised which involve or utilize the process of catalytically-supported, thermal combustion to which application Ser. No. 358,411 is directed. Among these is the method of U.S. application Ser. No. 463,436, now U.S. Pat. No. 3,940,923, filed Apr. 24, 1974, in the name of William C. Pfefferle and assigned to the same assignee as that of the present invention. Application Ser. No. 463,436 discloses, among other systems, a system in which fuel from one source is mixed with compressed air to give a first mixture, which may have an adiabatic flame temperature of about 2,600° F., and this fuel is burned in a catalyst bed giving an effluent having a temperature indicated to rise to 2,500° F. downstream of the catalyst. A portion of the same fuel-air mixture is added to the catalyst effluent and burns homogeneously as it passes through a first turbine wheel shown to have a temperature of 1,900°-2,000° F. In one arrangement fuel from a second source is mixed with the compressed air to provide another fuel-air mixture (preferably in proportions providing a mixture similar to the first mixture), which is introduced downstream of the first turbine wheel and burns in a second turbine wheel, where temperatures of 1,800°-1,700° F. are shown. Whether or not additional fuel-air mixtures are fed downstream of the catalyst in these various systems, burning of uncombusted fuel values occurs in the expansion zone or zones of the turbine to counteract the cooling effect of expansion, and, in the examples given, the various mixtures appear to have combustion temperatures (before such cooling) which are about the same throughout the system.

Also, in systems not utilizing a catalyst and involving elevated combustion temperatures, additional fuel conventionally may be introduced downstream of the main burner, as in jet engine reheat or afterburner systems. Illustrating a related system, the British Pat. No. 941,830 of the General Electric Company shows a conventional combustor for supplying a gas turbine engine. Primary fuel in the form of a kerosene-gasoline mixture is introduced through a nozzle to the dome at the upstream end of the combustor, and compressed air passes through openings in the combustor shell to swirl back into the dome, where combustion occurs at high temperatures, probably in the neighborhood of 4,000° F., as the air meets fuel vapors from the droplets leaving the nozzle. To permit burning some higher-energy fuel to increase turbine or jet engine performance, a borohydride fuel (which may contain hydrocarbons) is introduced just downstream of the point where the air circulates upstream. This permits burning of the borohydride in the downstream portions of the combustor without fouling the main nozzle and the relatively quiescent dome area with solid oxide deposits from the borohydride, and also without exposing the combustion liner to the extreme combustion temperature of high energy fuel since more cooling air is admitted to the downstream portions of the combustor.

SUMMARY OF THE INVENTION

In accordance with the principles of this invention, a first mixture of carbonaceous fuel and air is provided and passed to a combustion zone, containing a catalyst occupying a major portion of the flow cross section of the combustion zone, for at least partial combustion in the presence of the catalyst under essentially adiabatic conditions, as described above, to produce a first gaseous effluent. The catalyst operates at a temperature substantially above the instantaneous auto-ignition temperature of the first mixture but not exceeding about 3,000° F. Any of the fuels mentioned in application Ser. No. 358,411 may be used to form the first mixture and any of the fuel-air proportions mentioned in that application may comprise the first mixture. Similarly, although atmospheric air will usually be the source of oxygen for combustion of the fuel in the first mixture (as well as for combustion of the additional fuel combusted in accordance with the principles of this invention), it will be understood that the term "air" is used herein to mean any gas or combination of gases including oxygen available for combustion. It will sometimes be necessary herein to refer specifically to inert or recycle gases which in various applications of the present invention can be mixed with the fuel and air being combusted; this does not mean that the gases referred to as air herein cannot also include inert gases.

The first effluent produced as described above is mixed with a second carbonaceous fuel-containing component provided for that purpose, which may be with or without non-fuel components (i.e., air), to form a second mixture. This fuel-containing component is different from the first mixture and advantageously may utilize a fuel different from the fuel used in the first mixture. The fuel in the second fuel-containing component is a high energy fuel having an adiabatic flame temperature of at least about 3,300° F. if burned with a stoichiometric amount of air. The term "stoichiometric amount of air" as used herein means the amount of air of atmospheric composition which is theoretically just sufficient for complete combustion of all the carbon in a given amount of fuel to carbon dioxide and for complete combustion of any hydrocarbons in the fuel to carbon dioxide and water. The foregoing statement that the fuel in the second fuel-containing component has an adiabatic flame temperature of at least about 3,300° F. if burned with a stoichiometric amount of air does not mean that the fuel in the second fuel-containing component is in fact necessarily burned with astoichiometric amount of air in the method and apparatus of this invention.

The second mixture referred to above includes oxygen available for at least partial combustion of the fuel in the second fuel-containing component. This oxygen may be uncombined oxygen in the first effluent, or it may be air in the second fuel-containing component, or both. In addition, the second mixture has a temperature upon mixing at least sufficient to sustain homogeneous combustion of the second mixture. Furthermore, the composition and temperature of the second mixture should be such that its adiabatic flame temperature remains substantially above the operating temperature of the catalyst, so as to permit homogeneous combustion downstream in the system at temperatures higher than the highest temperature at which it may be desired to maintain the catalyst during sustained operation. The adiabatic flame temperature of the second mixture utilizing the heated first effluent, which might be typically above about 1,700° F., should be kept for purposes of the present invention in a range from about 2,500° to about 3,700° F. As used herein, the term "homogeneous combustion" means thermal combustion, which should be carried out with sufficiently uniform admixture of the components of the second mixture to avoid localized regions of substantially higher temperatures than the average temperature of the combustion zone.

The second mixture is homogeneously combusted to produce a second gaseous effluent which can be used as a source of heat or power. This combustion preferably occurs at a temperature low enough, and for a residence time of the mixture in the combustion zone short enough, to avoid substantial formation of nitrogen oxides. The combustion of the second mixture may be substantially adiabatic (for example, if the second effluent is to be used as a motive fluid for a turbine), or heat may be withdrawn from the combustion zone (for example, if the system is a furnace). Additional combustion stages similar to the combustion of the second mixture may be provided by mixing all or part of the second effluent with additional air if combustion of the second effluent is not complete, or with additional fuel-containing components with or without additional non-fuel components (e.g., air). Inert gases, such as the exhaust gases of the system, may be mixed with any of the fuel or air or both supplied to the system to improve the thermal efficiency of the system and control temperatures in the system. Any of the gases supplied to the system may be preheated, e.g., by heat exchange with the exhaust gases of the system, by compression in a compressor (in a turbine system), or by any other means.

Further features of the invention, its nature and various advantages will be more apparent from the accompanying drawings and the following detailed description of the invention.

DETAILED DESCRIPTION OF THE INVENTION

Figure 1:
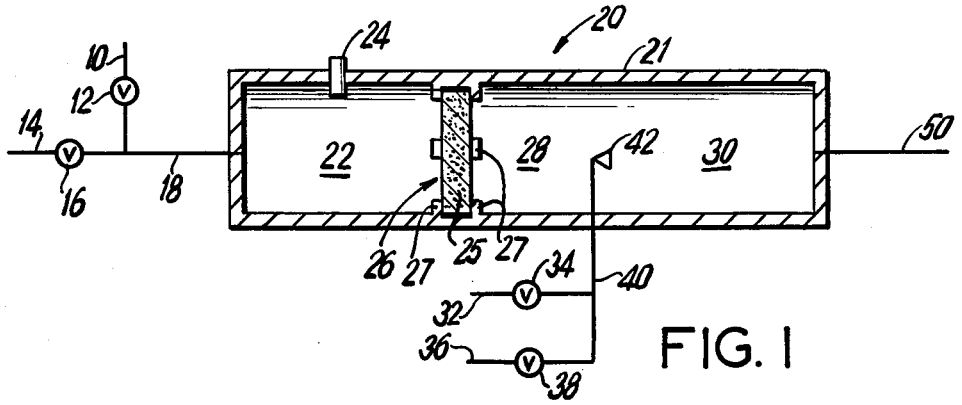
FIG. 1 is a partly schematic, partly simplified sectional view of combustor apparatus constructed and adapted for operation in accordance with the principles of this invention.

In the apparatus shown in FIG. 1, fuel is supplied via line 10 having valve 12 and air is supplied via line 14 having valve 16. Fuel from line 10 and air from line 14 are mixed to form a first mixture of fuel and air in line 18. The amounts and proportions of fuel and air in the first mixture are respectively controlled by valves 12 and 16 in accordance with the principles disclosed in co-pending application Ser. No. 358,411. Thus any of the fuels discussed in that application may be supplied via line 10 and mixed with air from line 14 in any amounts and proportions for effecting combustion at the desired operating temperature of the catalyst under the conditions existing in the combustion zone containing the catalyst. If desired, the air and/or fuel can be preheated (e.g., by compression in the system compressor if the system is a turbine system, by heat exchange with the exhaust gases of the system, etc.). Similarly, if desired, inert or substantially inert gases, such as the exhaust gases of the system, can be mixed with the fuel or air or both supplied via lines 10 and 12 (or mixed with the first mixture in line 18 or introduced separately into initial mixing zone 22 ) for thermal efficiency and to control temperatures in combustor 20. For convenience herein, any such inert gases supplied to combustor 20 will be referred to as "recycle gases", since in many cases these gases will be a recycled portion of the exhaust gases of the system. However, if a stream of inert or substantially inert gases is available from another source (e.g., a waste stream from another process), it will be understood that the term "recycle gases" also includes such gases.

The first mixture in line 18 is passed to combustor 20 having cylindrical housing 21, a longitudinal sectional view of which is shown in FIG. 1. Although a cyclindrical combustor is shown in FIG. 1, it will be understood that a wide variety of shapes can be employed, depending, for example, on the nature and configuration of the system in which the combustor is used. The first mixture is introduced into the initial portion of combustor 20, referred to herein as initial mixing zone 22. Although in the particular embodiment shown in FIG. 1, the first mixture of fuel and air is formed in line 18 prior to initial mixing zone 22, it will be understood that the fuel and air alternatively can be introduced into initial mixing zone 22 separately and mixed in that zone to form the first mixture. Initial mixing zone 22 includes an ignitor 24 which operates as discussed in application Ser. No. 358,411 to ignite the first mixture in zone 22 to heat catalyst 25 in catalyst-containing combustion zone 26 during start-up of the system. While ignitor 24 is operating, it may be necessary to supply fuel and air to the system in different amounts and proportions to insure a flammable mixture in zone 22 as discussed in the above-mentioned application. However, when catalyst 25 is at normal operating temperatures, ignitor 24 normally does not operate and there is preferably no combustion in initial mixing zone 22 prior to catalytic zone 26 at temperatures which would result in any substantial formation of nitrogen oxides.

The combustion zone 26 is disposed in combustor 20 downstream of the initial mixing zone 22 so that the gases in zone 22 pass through zone 26 to catalyst exit zone 28. Zone 26 includes a catalyst 25, which in the particular embodiment shown in FIG. 1 is a body disposed transverse to the longitudinal axis of combustor 20 and held in position by lugs or annular rings 27 on the inner surface of combustor housing 21. Catalyst 25 preferably occupies most or all of the flow cross-section of the combustion zone and includes a plurality of channels from initial mixing zone 22 to catalyst exit zone 28. At least a portion of the gases passing through the zone 26 containing the catalyst 25 thus are combusted in the presence of the catalyst, under the conditions described in application Ser. No. 358,411 and summarized above, to produce a first gaseous effluent. Any of the catalyst compositions and structures discussed in application Ser. No. 358,411 may be used for solid oxidation catalyst 25. For example, catalyst 25 may be a honeycomb catalyst having a plurality of channels parallel to the longitudinal axis of combustor 20. The adiabatic flame temperature of the fuel-air mixture entering the catalyst is in the range from about 1,700° to about 3,200° F., preferably from about 2,000° to, at most, only somewhat above 3,000° F. so that, for the adiabatic system illustrated in FIG. 1, the operating temperature of the catalyst (as indicated hereinabove) closely approaches this adiabatic flame temperature but does not exceed about 3,000° F. As mentioned hereinabove, the adiabatic flame temperature of the mixture entering the catalyst, which preferably is at about 2,000° F., also must be high enough so that, upon contact of the mixture with the catalyst, the operating temperatue of the catalyst is substantially above the instantaneous auto-ignition temperature of that mixture. When most of the fuel is burned while in the catalyst zone 26, the first effluent may exit from the catalyst zone at a temperature somewhat less than the adiabatic flame temperature of the entering mixture. The gases exiting from catalyst zone 26 may be completely combusted. Alternatively, combustion may continue downstream of zone 26 into catalyst exit zone 28, in which case the gases will exit from the catalyst zone at a temperature substantially below the operating temperature of the catalyst.

The first effluent passes from catalyst zone 28 to second mixing and combustion zone 30 where it is mixed and thermally combusted with a second fuel-containing component as will now be described. The second fuel-containing component is supplied to combustor 20 via line 40 and sprayed into second mixing and combustion zone 30 by nozzle 42 for mixing with the first effluent from catalyst exit zone 28 to produce a second mixture in zone 30. The second fuel-containing component differs in the nature, or proportion, or both, of the fuel, as compared with the first mixture entering the catalyst 25, and includes fuel supplied to line 40 via line 32 having valve 34 and may also include nonfuel components (e.g., air) supplied to line 40 via line 36 having valve 38. As discussed in application Ser. No. 358,411, the proportions of fuel and air in the first mixture (at least partially combusted in catalyst zone 26 as discussed above) may be approximately stoichiometric if desired catalyst operating temperature is not exceeded, or the proportions may be non-stoichiometric on the fuel-rich or fuel-lean side. If the mixture is approximately stoichiometric, substantially all the fuel in the first mixture is typically combusted in catalyst zone 26 and in catalyst exit zone 28. If the first mixture is fuel-rich, there will be uncombusted fuel values in the first effluent. If the first mixture is fuel-lean, there will be oxygen in the first effluent available for combustion of additional fuel. If there is sufficient oxygen available in the first effluent for combustion of the fuel in the second fuel-containing component, additional air may not be required or desired in the second fuel-containing component. On the other hand, if there is insufficient oxygen in the first effluent for combustion of the fuel in the second fuel-containing component or if there is uncombusted fuel in the first effluent, the second fuel-containing component contains air for combustion of the fuel in the second fuel-containing component and any uncombusted fuel in the first effluent. In any event, it is preferred in accordance with the present invention that the fuel-air mixture in the second fuel-containing component, especially when the same fuel is used, be substantially richer in fuel values than the first fuel-air mixture.

The fuel supplied via line 32 may be the same as the fuel supplied via line 10 but in a different mixture with air, or it may be a different fuel. In any event, the fuel in the second fuel-containing component is a high energy fuel having an adiabatic flame temperature of at least about 3,300° F. if burned with a stoichiometric amount of air. One of the advantages of this invention is that fuel which may be inconvenient or unsuitable for combustion in the presence of the catalyst in zone 26 can be supplied via line 32 and combusted downstream of the catalyst. Thus, for example, fuels substantially contaminated with sulfur which might poison the catalyst in zone 26 can be supplied via line 32 and combusted without danger to the catalyst. Other examples are fuels yielding combustion products with substantial ash content, and fuels having high boiling points and difficult to vaporize and admix intimately with air prior to contacting the catalyst 25 upon reaching the inlet to zone 26.

As in the case of the components supplied via lines 10 and 14, either or both of the components supplied via lines 32 and 36 can be preheated if desired by any of the means mentioned above. Similarly, recycle gases can be mixed with either or both of the components supplied via lines 32 and 36 for thermal efficiency and to control temperatures in combustor 20, particularly in mixing and combustion zone 30.

As mentioned above, the second fuel-containing component is mixed with the first effluent to form a second mixture in zone 30. This second mixture has a temperature at least sufficient to sustain homogeneous combustion of the second mixture and has an adiabatic flame temperature substantially above the operating temperature of the catalyst but below about 3,700° F. This permits further combustion in the system at temperatures above the highest temperature at which it may be desired to maintain the catalyst during sustained operation. Typically, the temperature of the second mixture upon mixing, but determined without any heating by further combustion, is at least about 1,700° F., preferably at least about 2,000° F., and the adiabatic flame temperature of the second mixture is in the range from about 2,500° to about 3,700° F. When the adiabatic flame temperature of the second mixture is above 3,300° F., precautions may be desirable to minimize nitrogen oxide formation, as discussed hereinbelow. In second mixing and combustion zone 30 the second mixture is thermally combusted to produce a second gaseous effluent. Nozzle 42 may be positioned at a point where combustion of the gases exiting from the zone 26 containing the catalyst is still continuing, so that combustion is continuous from zone 28 to zone 30, or nozzle 42 may be positioned at a point where combustion of the first effluent has stopped so that there is a discontinuity in combustion from zone 28 to zone 30. The second gaseous effluent is used as a source of heat or power. For example, heat may be withdrawn from the gases in zone 30 by heat exchange, e.g., to generate steam.

Alternatively, the combustion taking place in combustor 20 may be substantially adiabatic throughout and the second effluent may be conducted from the combustor via line 50 for transfer of heat therefrom at another location or for use as a motive fluid for a turbine. The exhausted second effluent subsequently exits from the system. Additional heat may be recovered from the exhaust gases to preheat the fuel or air or both supplied to the system as mentioned above. A portion of the exhaust gases may be mixed with the fuel or air or both supplied to the system as the above-mentioned recycle gases.

Although only one nozzle 42 is shown in the simplified schematic of FIG. 1, it will be understood that any number and arrangement of such nozzles can be provided to insure effectively complete mixing of the second fuel-containing component with the first effluent, as is desirable to insure homogeneous combustion of the resulting second mixture with reasonable uniformity of temperature in zone 30. Similarly, although additional fuel-containing component is introduced at only one location along the longitudinal axis of combustor 20 in FIG. 1, it will be understood that any number of successive mixing and combustion zones similar to zone 30 can be provided along the length of the downstream portion of combustor 20 with additional fuel-containing component supplied to each of these zones.

Figure 2:
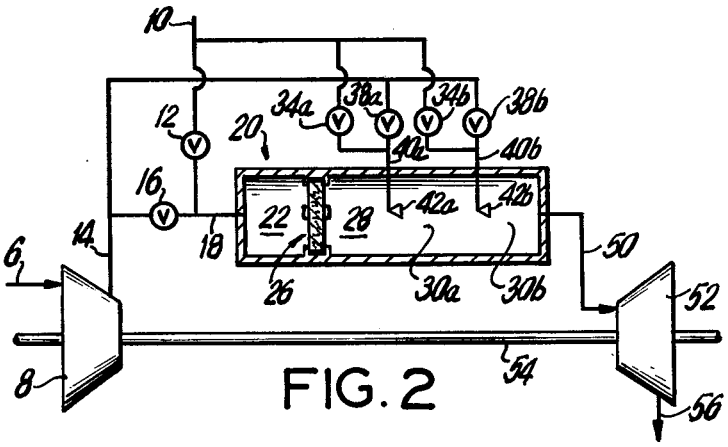
FIG. 2 is a partly schematic, partly simplified sectional view showing a turbine system including combustor apparatus constructed and adapted for operation in accordance with the principles of this invention.

A turbine system constructed and operated in accordance with the principles of this invention is shown in FIG. 2. Combustor 20 in this system is similar to combustor 20 in FIG. 1, except that two successive mixing and combustion zones **30*a* and 30*b*, each similar to the mixing and combustion zone 30 in FIG. 1, are provided in the combustor shown in FIG. 2. In the turbine system of FIG. 2, air is brought into the system via line 6 and compressed in compressor 8. Power to drive compressor 8 is supplied from turbine 52 via shaft 54. Compressed air exits from compressor 8 via line 14. Typically, the air in line 14 is at elevated temperature as well as pressure. For example, depending on the compression ratio of compressor 8, the air in line 14** may be at a temperature as high as about 1,100° F.

At least a portion of the air in line 14 passes through valve 16 and is mixed with a portion of the fuel supplied to the system via line 10 to form a first mixture of fuel and air in line 18 similar to the first mixture in line 18 in FIG. 1. The amount of fuel from line 10 going to line 18 is controlled by valve 12 as in FIG. 1. The first mixture in line 18 is supplied to initial mixing zone 22 of combustor 20. From initial mixing zone 22 the first mixture passes to the catalyst-containing zone 26 and is at least partially combusted therein, as in zone 26, in FIG. 1, to produce a first gaseous effluent which passes to catalyst exit zone 28. In second mixing and combustion zone **30*a*, the first effluent is mixed with a second fuel-containing component supplied via line 40*a* and nozzle 42*a* to form a second mixture having similar characteristics to those of the second mixture in FIG. 1 and which is homogeneously combusted in zone 30*a*, under conditions similar to the combustion of the second mixture in FIG. 1, to produce a second gaseous effluent. Fuel is supplied to line 40*a* from line 10 in an amount determined by valve 34*a*. This fuel is similar to the fuel in the second fuel-containing component in FIG. 1 in that it is a high energy fuel having an adiabatic flame temperature of at least about 3,300° F. if burned with a stoichiometric amount of air. In the embodiment shown in FIG. 2 the same fuel is supplied throughout the system although it will be understood that different fuels can be supplied to different combustion zones if desired as discussed above in connection with FIG. 1. The second fuel-containing component in line 40*a* may also include air supplied from line 14 via valve 38*a* and mixed with the fuel in line 40*a***.

The second gaseous effluent is passed to third mixing and combustion zone **30*b*, where it is mixed with a third fuel-containing component supplied to the combustor via line 40*b* and nozzle 42*b* to produce a third mixture. Fuel is supplied to line 40*b* from line 10 in an amount determined by valve 34*b*. Again, although this is the same fuel supplied to the other combustion zones of the system, in the particular embodiment shown in FIG. 2, a different fuel may be supplied if desired. In any event, this fuel has an adiabatic flame temperature of at least about 3,000° F. if burned with a stoichiometric amount of air. The third fuel-containing component in line 40*b* may also include air supplied from line 14 via valve 38*b* and mixed with the fuel in line 40*b*. The third mixture formed in zone 30*b* also has properties similar to those of the second mixture in FIG. 1. Thus the temperature of the third mixture is at least sufficient to sustain homogeneous combustion of the third mixture and has an adiabatic flame temperature at least above the temperature of the first effluent but below about 3,700° F. As in the case of the second mixture both in FIG. 1 and FIG. 2, the temperature of the third mixture is typically at least about 1,700° F., preferably at least about 2,000° F., and the adiabatic flame temperature of the third mixture is in the range from about 2,500° to about 3,700° F. The third mixture is homogeneously combusted in zone 30*b* to produce a third gaseous effluent which exits from combustor 20 via line 50**.

To avoid substantially or minimize sharply any formation of oxides of nitrogen in either of the thermal combustion zones **30*a* and 30*b***, especially when the adiabatic flame temperature is in the approximate range of 3,300° F. to 3,700° F., the residence time of the mixture undergoing combustion should be limited, with or without air-quenching on leaving one or both of the thermal combustion zones, since nitrogen oxide formation is a function of both time and temperature for a given combustion mixture.

The third gaseous effluent in line 50 is supplied as a motive fluid to drive turbine 52. A portion of the power produced by turbine 52 is used to drive compressor 8 via shaft 54 as mentioned above. The remaining power is available on shaft 54 for the purpose for which the system is being operated (e.g., to drive an electrical power generator). The gases exiting from turbine 52 via line 56 are exhausted from the system, generally into the atmosphere.

Figure 3:
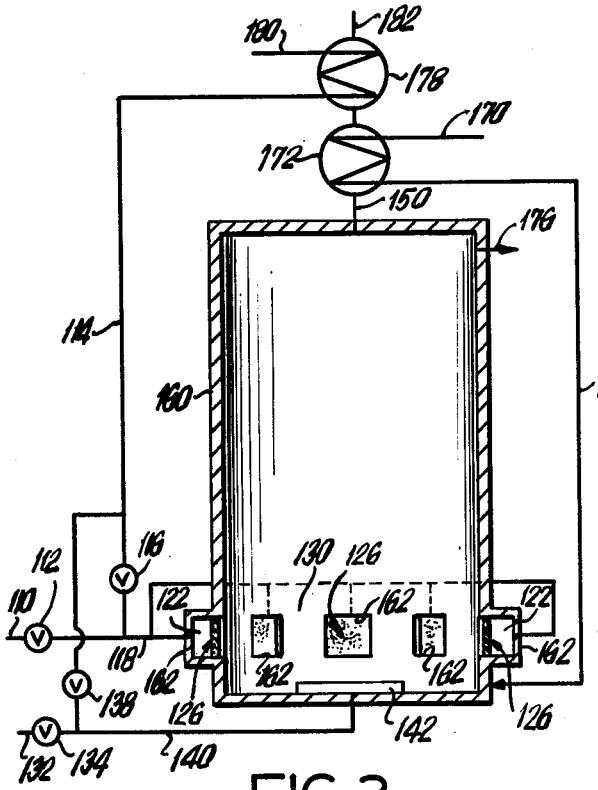
FIG. 3 is a partly schematic, partly sectional view of a furnace constructed and adapted for operation in accordance with the principles of this invention.

A furnace system constructed and adapted for operation in accordance with the principles of this invention is shown in FIG. 3. In the system of FIG. 3 a vertically disposed furnace housing 160 has a plurality of laterally extending enclosures 162 spaced around its periphery near the bottom of the housing. Although in the particular embodiment shown in FIG. 3 housing 160 is basically cylindrical and enclosures 162 therefore extend radially from housing 160, any of a wide variety of configurations can be employed, as will be apparent to those skilled in the art. Each of enclosures 162 is similar to the initial portion of combustor 20 in FIGS. 1 and 2. Each enclosure 162 therefore includes an initial mixing zone 122 similar to initial mixing zone 22 in FIGS. 1 and 2 and a zone 126, containing a catalyst, similar to catalyst zone 26 in FIGS. 1 and 2. A portion of a first mixture of fuel and air similar to the first mixture of FIG. 1 and formed as described below is supplied to each of enclosures 162 and at least partly combusted in the associated catalyst zone 126 as in catalyst zone 26 in FIG. 1 to produce a first gaseous effluent, which enters the lower portion 130 of the interior of housing 160 (referred to herein as second mixing and combustion zone 130). In zone 130 the first effluent from all of enclosures 162 is mixed with a second fuel-containing component formed as described below and supplied to zone 130 by diffuser 142 to produce a second mixture similar to the second mixture formed in zone 30 in FIG. 1. This second mixture is homogeneously combusted in zone 130 as in zone 30 in FIG. 1 to produce a second gaseous effluent. Heat is withdrawn from this second gaseous effluent as it rises in housing 160 to heat steam in a system of boiler tubes (not shown) connected between lines 174 and 176. When the second effluent is too cool for further efficient transfer of heat to the liquid water condensate being vaporized to steam in the boiler tube system, the second effluent exits from the upper portion of housing 160 via line 150. Line 150 may conduct the second effluent to successive heat exchangers 172 and 178 for preheating respectively condensate returned to the system via line 170 and air brought into the system via line 180. The preheated condensate is supplied to the boiler tube system associated with housing 160 via line 174 and the fully heated steam exits from that boiler tube system via line 176. The preheated air is distributed to the system via line 114. The second effluent is finally exhausted from the system via line 182.

The first mixture of fuel and air mentioned above is formed in line 118 by mixing fuel supplied via line 110 having valve 112 with air from line 114 supplied via valve 116. As mentioned above, this first mixture has the characteristics specified above for the first mixture in FIG. 1. Fuel for the second fuel-containing component is supplied to diffuser 142 via line 132 having valve 134 and line 140. This fuel may be the same as that supplied via line 110 or it may be a different fuel. In any event, the fuel in the second fuel-containing component is a high energy fuel having an adiabatic flame temperature of at least about 3,300° F. if burned with a stoichiometric amount of air. The second fuel-containing component may also include air supplied from line 114 via valve 138.

Figure 4:
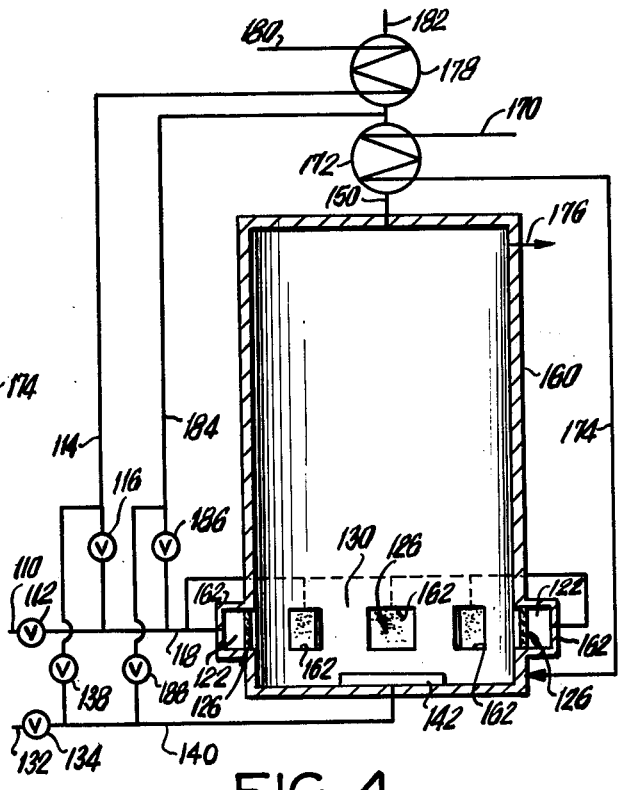
FIG. 4 illustrates an alternative embodiment of the furnace of FIG. 3.

FIG. 4 shows a modification of the furnace of FIG. 3 in which a portion of the final combustion effluent of the furnace can be mixed as recycle gases with either the first mixture of fuel and air or the second fuel-containing component, or both, to control temperatures in the furnace and improve the thermal efficiency of the furnace. The recycle gases help to control temperatures in the system by diluting the fuel-air mixtures with which they are mixed. Such use of these gases also may improve the thermal efficiency of the system by conserving heat values within the system which would otherwise be lost to the atmosphere. The furnace of FIG. 4 is identical to the furnace of FIG. 3 with the addition of line 184 for drawing off and recycling a portion of the final combustion effluent between heat exchangers 172 and 178. The recycle gases in line 184 are typically substantially inert since it is usually preferable to operate a furnace with no more air in excess of the stoichiometric amount for the total amount of fuel supplied to the furnace than is actually necessary to insure complete combustion of all that fuel, although these recycle gases may contain some oxygen available for combustion. The recycle gases in line 184 are also typically at a temperature above ambient temperature. A portion of the recycle gases in line 184 may be supplied to line 118 via valve 186 and mixed with the first mixture of fuel and air in line 118. Alternatively or in addition, a further portion of the recycle gases in line 184 may be supplied to line 140 via valve 188 and mixed with the second fuel-containing component in line 140.

Although in the particular embodiment shown in FIG. 4 the recycle gases are withdrawn between heat exchangers 172 and 178, it will be understood that these gases can be withdrawn at any point (e.g., ahead of heat exchanger 172 or after heat exchanger 178). Similarly, although the recycle gases are mixed with the first mixture and with the second fuel-containing component fter the fuel and air have been mixed, it will be understood that these three components can be mixed in any order. Alternatively, any one or more of these components can be supplied to the furnace separately and mixed in the furnace (e.g., in initial mixing zones 122 in the case of the gases comprising the first mixture or in second mixing and combustion zone 130 in the case of the gases comprising the second fuel-containing component).

It is to be understood that the embodiments shown and described herein are illustrative of the principles of this invention only and that various modifications may be implemented by those skilled in the art without departing from the scope and spirit of the invention. For example, although heat exchange to steam is employed in the furnace systems shown in FIGS. 3 and 4, heat exchange to any other medium (e.g., air) may alternatively be employed, or the furnace may comprise a pipe still with the heat being transferred directly to a fluid being processed in the still.

What is claimed is:

1. The method of combusting carbonaceous fuel comprising the steps of:

providing a first mixture of carbonaceous fuel and air;

passing said first mixture to a combustion zone, containing a catalyst occupying a major portion of the flow cross section of said combustion zone, for combustion of at least a portion of said first mixture under essentially adiabatic conditions in the presence of said catalyst, operating at a temperature substantially above the instantaneous auto-ignition temperature of said first mixture but not exceeding about 3000° F., to produce a first gaseous effluent;

providing a carbonaceous fuel-containing component differing from said first mixture, the fuel in said fuel-containing component having an adiabatic flame temperature of at least about 3300° F. when burned with a stoichiometric amount of air; and mixing said first effluent and said fuel-containing component to form a second mixture having a temperature upon mixing at least sufficient to sustain homogeneous combustion of said second mixture and having an adiabatic flame temperature in the range from about 2500° F. to about 3700° F. and substantially above said operating temperature of the catalyst, thereby homogeneously combusting said mixture to produce a second gaseous effluent.

2. The method of claim 1, wherein said first mixture entering the catalyst has an adiabatic flame temperature which is at least about 2000° F. and which also is high enough so that, upon contact of the mixture with the catalyst, the operating temperature of the catalyst is substantially above the instantaneous auto-ignition temperature of said first mixture.

3. The method of claim 1, wherein the carbonaceous fuel in said fuel-containing component is different from the fuel used in providing said first mixture.

4. The method of claim 3, wherein the carbonaceous fuel in said fuel-containing component is a fuel inconvenient or unsuitable for combustion in the presence of said catalyst and is selected from the group consisting of substantially sulfur-contaminated fuels, fuels yielding combustion products with substantial ash content, and high-boiling fuels difficult to vaporize and admix with air prior to contacting the catalyst.

5. The method of claim 1, wherein the temperature of said second mixture upon mixing, but without any heating by further combustion, is at least about 1700° F.

6. The method of claim 1, wherein the temperature of said second mixture upon mixing, but without any heating by further combustion, is at least about 2000° F.

7. The method of claim 1, comprising the further steps of converting a portion of the thermal energy in said second gaseous effluent to work, and mixing a portion of said second gaseous effluent with said first effluent and said fuel-containing component to form said second mixture.

8. The method of claim 1, comprising the further steps of withdrawing at least a portion of the thermal energy from said second gaseous effluent by transfer of heat from said second gaseous effluent, and mixing a portion of said second gaseous effluent with said first effluent and said fuel-containing component to form said second mixture.

9. The method of claim 1, wherein the carbonaceous fuel in said first mixture and the carbonaceous fuel in said fuel-containing component are combusted to provide a motive fluid for a gas turbine, said method further comprising the step of supplying said second gaseous effluent as a motive fluid to drive said turbine.

10. The method of claim 1, wherein the carbonaceous fuel in said first mixture and the carbonaceous fuel in said fuel-containing component are combusted to provide heat for the generation of steam, said method further comprising the step of transferring heat from said second gaseous effluent to a liquid water condensate to generate steam.

* * * * *

UNITED STATES PATENT AND TRADEMARK OFFICE

CERTIFICATE OF CORRECTION

PATENT NO. : 4,197,701

DATED : April 15, 1980

INVENTOR(S) : Asmund A. Boyum

It is certified that error appears in the above-identified patent and that said Letters Patent are hereby corrected as shown below:

In Column 1, line 14, between "use and "a" insert --as--
line 27, change "348,411" to --358,411--.

In Column 3, line 25, change "astoichiometric" to
--a stoichiometric--.

Signed and Sealed this

*Ninth* Day of *September 1980*

[SEAL]

*Attest:*

SIDNEY A. DIAMOND

*Attesting Officer*

*Commissioner of Patents and Trademarks*